United States Patent [19]

Takegawa

[11] Patent Number: 4,958,662

[45] Date of Patent: Sep. 25, 1990

[54] PICK EXTRACTING DEVICE WITH ROTATIVE DRIVE

[75] Inventor: Yujiro Takegawa, Uchinada, Japan

[73] Assignee: Tsudakoma Corporation, Kanazawa, Japan

[21] Appl. No.: 334,865

[22] Filed: Apr. 6, 1989

[30] Foreign Application Priority Data

Apr. 6, 1988 [JP] Japan ..... 63-84570

[51] Int. Cl.[5] ..... D03D 49/00

[52] U.S. Cl. ..... 139/116.2

[58] Field of Search ..... 139/116.2, 435; 57/304–307; 289/5–12; 112/121.2; 28/211

[56] References Cited

U.S. PATENT DOCUMENTS

| | | | |
|---|---|---|---|
| 4,529,010 | 7/1985 | Aarts | 139/116 A |
| 4,664,157 | 5/1987 | Shin | 139/116 A |
| 4,749,006 | 6/1988 | Miyamoto | 139/116 A |

FOREIGN PATENT DOCUMENTS 61-150876 9/1986 Japan .

*Primary Examiner*—Andrew M. Falik

*Attorney, Agent, or Firm*—Wenderoth, Lind & Ponack

[57] ABSTRACT

A weft yarn extracting device for extracting a weft yarn faultily inserted in a cloth fell includes an extracting unit including a pair of fingers, a first shifting unit for shifting the extracting unit between a standby position and an operating position, and a second shifting unit for turning the extracting unit about an axis. In operation, one end of the weft yarn is sucked in the extracting unit by the agency of an air current and is gripped by gripping members. Then, the gripping members are rotated to extract the weft yarn by winding the weft yarn around the gripping members, while the extracting unit is turned about an axis by the second shifting unit to separate the weft yarn from the cloth fell.

4 Claims, 7 Drawing Sheets

PICK EXTRACTING DEVICE WITH ROTATIVE DRIVE

BACKGROUND OF THE INVENTION

1. Field of the Invention

The present invention relates to a weft yarn extracting device for extracting a picked weft yarn from the cloth fell of a fabric.

2. Description of the Prior Art

When a short pick occurs during weaving, a shortly picked weft yarn is inserted in a shed only in a portion of the entire width of the cloth fell and hence an insufficient beating force acts on a portion of the cloth fell where the weft yarn does not exist. Accordingly, a portion of the weft yarn inserted in the preceding picking cycle and corresponding to the portion of the cloth fell where no weft yarn exists is not beaten satisfactorily. On the other hand, when a weft yarn is inserted in a shed with the leading end thereof doubled back, two weft yarns are extended in a portion of the cloth fell in a double pick mode, so that a portion of a weft yarn inserted in the preceding picking cycle and corresponding to the portion of the cloth fell where the two weft yarns are extended is beaten excessively. Such a faulty weft yarn insertion causes picking barres. Therefore, when a faulty weft insertion occurred, the improperly inserted weft yarn and several weft yarns inserted in the preceding picking cycles must be extracted from the cloth. An inserted weft yarn extracting device is used for the automatic extraction of inserted weft yarns.

Inventions relating to a weft yarn extracting device for such a purpose are disclosed in U.S. Pat. Nos. 4,502,512 and 4,688,606. According to these inventions, a cutting device disposed on the picking side of a loom is held inoperative when a faulty weft yarn insertion occurs to leave the improperly inserted weft yarn extending from the picking nozzle; the improperly inserted weft yarn is then gripped by a gripper, and then the improperly inserted weft yarn is extracted by the gripper. Although such a weft yarn extracting means, as compared with those disclosed in U.S. Pat. Nos. 4,529,010 and 4,503,889, which extract an improperly inserted weft yarn from the cloth fell after cutting the improperly inserted weft yarn off the picking nozzle, is capable of surely catching the improperly inserted weft yarn, it is impossible to extract weft yarns normally inserted in the preceding picking cycles by this weft yarn extracting device, and hence this weft yarn extracting device is unable to deal effectively with the disposal of picking barres caused by an improperly inserted weft yarn.

SUMMARY OF THE INVENTION

Accordingly, it is an object of the present invention to provide a weft yarn extracting device capable of surely extracting weft yarns inserted in the previous picking cycles prior to a picking cycle in which a weft yarn is improperly inserted, to prevent faults in the cloth, such as picking barres.

To achieve the object of the invention, a weft yarn extracting device in accordance with the present invention grips a portion of an inserted weft yarn at the picking side extending between the selvage of the cloth and a series of interlacing yarns by an extracting means, and the inserted weft yarn is extracted from the cloth fell by the rotary motion of the extracting means while the inserted weft yarn is separated from the cloth fell by the turning motion of first and second shifting means. The extracting means sucks in the end of one weft yarn, and then holds the end of the weft yarn between a nozzle and a rotary tube or between a pair of fingers, and then rotates the nozzle and the rotary tube or the pair of fingers to extract the weft yarn by winding same. Thus, an improperly inserted weft yarn and weft yarns inserted in the prior picking cycles can surely be extracted while it is on open shed.

According to the present invention, the extracting means grips positively only the weft yarn in an open shed and separated from the cloth fell and winds the weft yarn to extract same from the cloth fell. Accordingly, it is possible to extract the weft yarn continuously even if the weft yarn has already been cut off the picking nozzle, and hence a plurality of weft yarns inserted previously in prior picking cycles, as well as the improperly inserted weft yarn, such as a short pick, can be extracted one by one.

Particularly, in an embodiment in which an extracting means sucks in the end of a weft yarn to be extracted between a nozzle and a rotary tube by the agency of an air current, only a weft yarn is an open shed is sucked together with the air current into the extracting means. Therefore, a plurality of inserted weft yarns can surely and sequentially be extracted one at a time.

The above and other objects, features and advantages of the present invention will become more apparent from the following description taken in conjunction with the accompanying drawings.

DESCRIPTION OF THE PREFERRED EMBODIMENTS

First Embodiment

Figure 1:
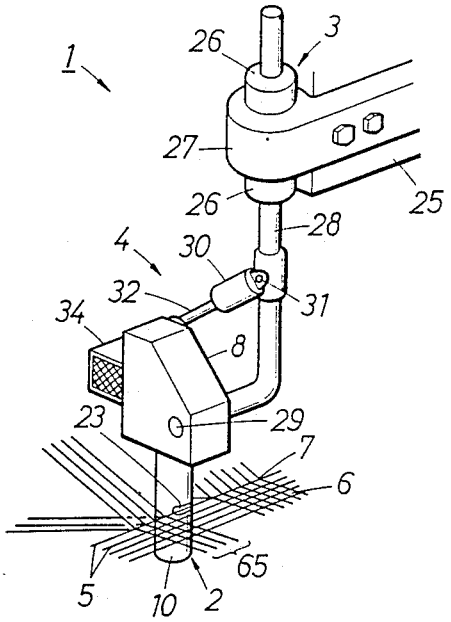
FIG. 1 is a perspective view of a weft yarn extracting device in a first embodiment according to the present invention.

Referring to FIG. 1, a weft yarn extracting device 1 comprises an extracting unit 2, a first shifting unit 3 and a second shifting unit 4.

The extracting unit 2 sucks in and grips a portion of a weft yarn 5 to be extracted extending between the selvage of a cloth 6 and interlacing yarns 65 and extracts the weft yarn 5 from the cloth fell 7 of the cloth 6 by a rotary motion.

Figure 2:
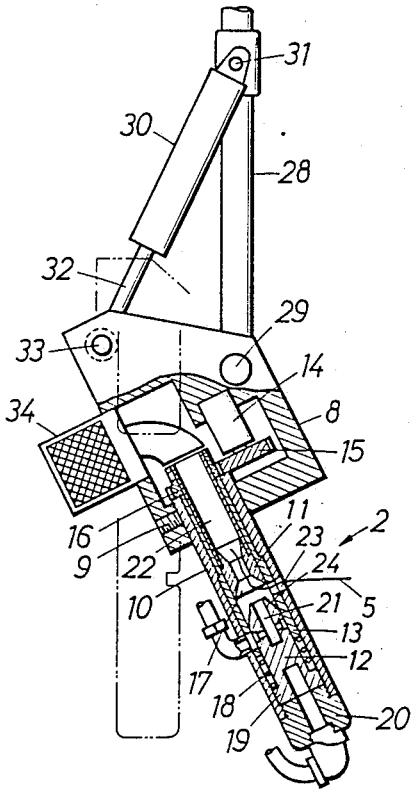
FIG. 2 is an enlarged sectional view of an essential portion of the weft yarn extracting device of FIG. 1.

As best shown in FIG. 2, the extracting unit 2 comprises a holder 8, a tubular case 10 fixed to the holder 8 with a screw 9 and provided with a suction hole 23, a sleeve 13 fitted in the tubular case 10, a rotary tube 11 rotatably fitted in the sleeve 13 and provided with an axial suction bore 22 and a taper surface 17 formed at the lower end, as viewed in FIG. 2, of the suction bore 22, a nozzle 12 rotatably and axially slidably fitted in the sleeve 13 opposite to the rotary tube 11, having a taper head 24 of a shape fitting the taper surface 17 of the rotary tube 11, and provided with an axial nozzle hole 21, a motor 14 mounted on the holder 8, a gear 15 fixed to the output shaft of the motor 14, a gear 16 fixed to the upper end, as viewed in FIG. 2, of the rotary tube 11 and engaging the gear 15, a spring 18 biasing the nozzle 12 away from the rotary tube 11, a piston 19 formed integrally with the lower end, as viewed in FIG. 2, of the nozzle 12, and an end cap 20 closing the lower end, as viewed in FIG. 2, of the tubular case 10. A pressurized fluid is supplied through a through hole formed in the end cap 20 to advance the nozzle 12 toward the rotary tube 11 to make the taper head 24 of the nozzle 12 engage the taper surface 17 of the rotary tube so that the weft yarn 5 is gripped between the rotary tube 11 and the nozzle 12.

An air current flowing from outside the tubular case 10 through the suction hole 23 into the interior of the tubular case 10 is generated by jetting air through the nozzle hole 21 toward the suction bore 22 of the rotary tube 11. The axial bore 22 of the rotary tube 11 communicates with a waste basket 34 attached to the holder 8.

The first shifting unit 3 shifts the extracting unit 2 between a standby position and an operating position. The first shifting unit 3 comprises a pneumatic actuator 26 having a piston rod 28 connected at the extremity thereof to a horizontal pin 29 rotatably supporting the holder 8, and a bracket 27 holding the pneumatic actuator 26 in a vertical position on a frame member 25 of a loom.

The second shifting unit 4 turns the extracting unit 2 between a gripping position and a retracting portion separated backward from the cloth fell 7. The second shifting unit 4 comprises the horizontal pin 29, a pneumatic actuator 30 having one end pivotally joined to the piston rod 28 of the pneumatic actuator 26 by a pin 31. The piston rod 32 of the pneumatic actuator 30 is joined pivotally at the extremity thereof to the holder 8 by a pin 33.

Figure 3:
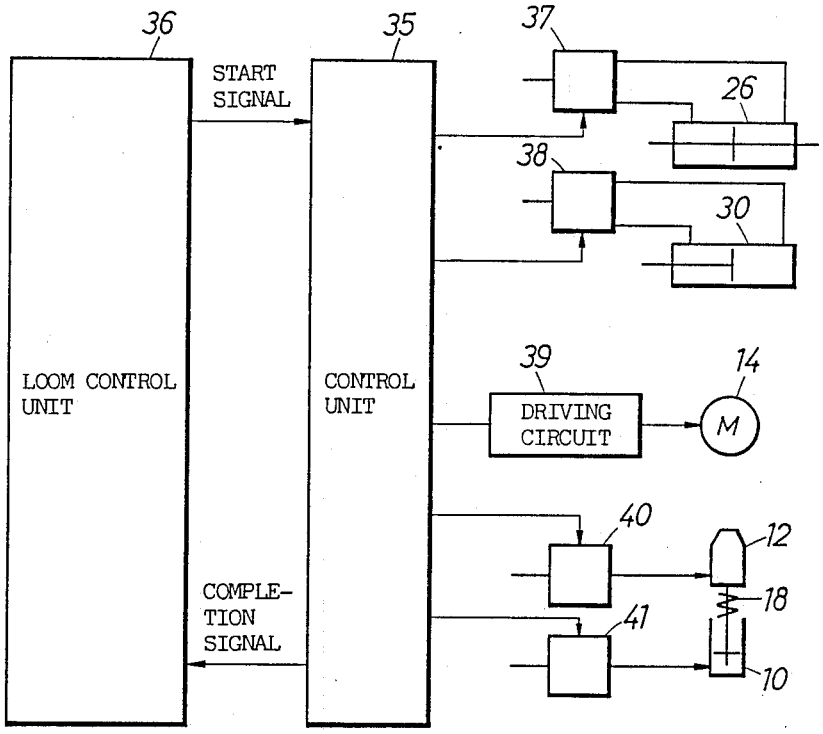
FIG. 3 is a block diagram showing the connection of a control unit and controlled components in the weft yarn extracting device of FIG. 1.

Referring to FIG. 3, a control unit 35 executes a predetermined control procedure upon the reception of an actuation signal from a loom control unit 36 for controlling the operation of the loom. Selector valves 37 and 38 respectively for controlling the pneumatic actuators 26 and 30, a driving circuit 39 for driving the motor 14, a solenoid valve 40 for controlling the supply of compressed air to the nozzle 12, and a solenoid valve 41 for controlling the axial movement of the nozzle 12 are connected to the control unit 35.

Figure 4:
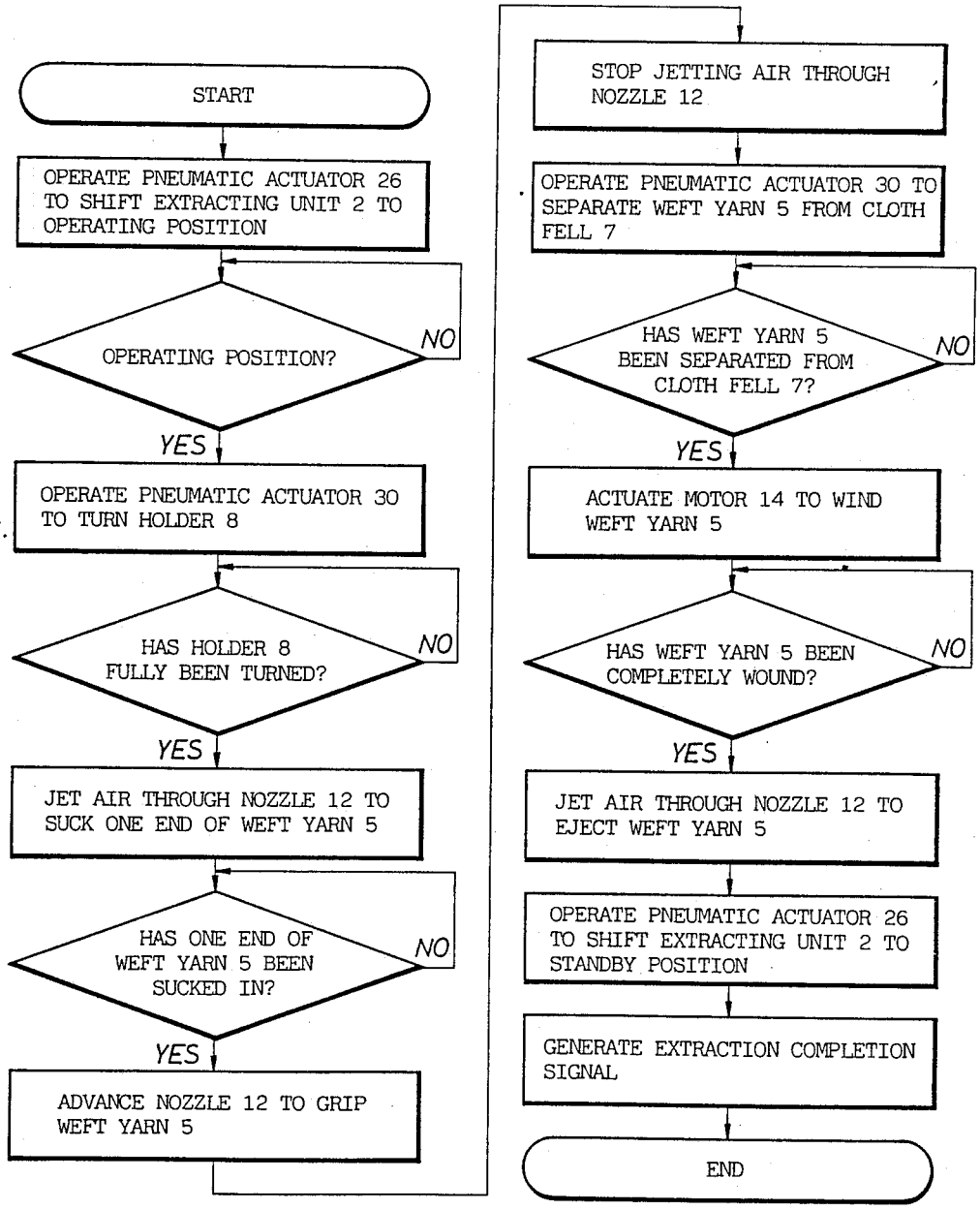
FIG. 4 is a flow chart of a control routine to be executed by the control unit of the weft yarn extracting device of FIG. 1.

A loom stop signal is given to the control unit 36 of the loom when a weft yarn is improperly inserted during weaving. Then, the loom control unit 36 stops the loom automatically at a predetermined stopping phase angle in the next picking cycle while it is stopping the next picking, and reverses the loom to find the pick and open the corresponding shed so that the improperly inserted weft yarn 5 extends in a free state along the cloth fell 7, and then gives a weft yarn extraction start signal to the control unit 35. Then, the control unit 35 starts a control routine as shown in FIG. 4 and described below.

First, the control unit 35 operates the selector valve 37 to shift the piston rod 28 of the pneumatic actuator 26 from an uppermost position to a lowermost position to shift the extracting unit 2 from the standby position to the operating position, and then, after it has been determined that the operating position has been reached, the control unit 35 operates the selector valve 28 to project the piston rod 32 of the pneumatic actuator 30 to turn the holder 8 counterclockwise, as viewed in FIG. 2, on the pin 29. Consequently, the suction hole 23 is located near the weft yarn 5 to be extracted. Although the weft yarn 5 extends along the cloth fell 7 and the end of the weft yarn 5 is held by the interlacing yarns 65, the weft yarn 5 can be separated from the cloth fell 7 and the interlacing yarns 65, since the corresponding shed is open. In this state, after it has been determined that holder 8 has been fully turned, the control unit 35 opens the solenoid valve 40 to jet air from the nozzle 12 into the axial bore 22 of the rotary tube 11 to generate a suction air current flowing through the suction hole 23 from outside the tubular case 10, whereby the end of the weft yarn 5 is sucked together with the suction air current into the tubular case 10 and then into the axial bore 22 of the rotary tube 11. Upon the recognition of suction of the end of the weft yarn 5 into the axial bore 22 of the rotary tube 11, the control unit 35 opens the supply port of the solenoid valve 41 to advance the nozzle 12 together with the piston 19 toward the rotary tube 11 so that the end of the weft yarn 5 is held between the tapered surface 17 of the rotary tube 11 and the tapered head 24 of the nozzle 12, and then closes the solenoid valve 40 to stop jetting air through the nozzle 12.

Then, the control unit 35 switches over the selector valve 38 to retract the piston rod 32 of the pneumatic actuator 30 to turn the holder 8 clockwise, as viewed in FIG. 2, so that the extracting unit 2, more particularly, the suction hole 23 of the extracting unit 2, is located away from the extension of the cloth fell 7 to separate the weft yarn from the cloth fell 7. Then, after it has been determined that the weft yarn 5 has been separated from the cloth fell 7, the control unit 35 actuates the driving circuit 39 to drive the motor 14 to rotate the rotary tube 11 together with the nozzle 12 to wind the weft yarn 5 around the taper head 24 of the nozzle 12, so that the weft yarn 5 is extracted gradually from the cloth fell 7. After a predetermined time has passed since the actuation of the driving circuit 39 or, as shown in FIG. 4, after the confirmation of complete extraction of the weft yarn 5 by a sensor, not shown, the control unit 35 opens the discharge port of the solenoid valve 41 so that the nozzle 12 is retracted from the rotary tube 11 by the resilience of the spring 18, opens the solenoid valve 40 again to remove the coiled weft yarn 5 from the tape head 24 of the nozzle 12 and to send the extracted weft yarn 5 through the axial bore 22 of the rotary tube 11 into the waste basket 34 by blowing air through the nozzle 12, operates the selector valve 37 to move up the extracting unit 2 to the standby position by retracting the piston rod 28 of the pneumatic actuator 26, and then gives an extraction completion signal to the loom control unit 36 to end the control routine. Upon the reception of the extraction completion signal from the control unit 35, the loom control unit 36, when necessary, reverses the loom again to open a shed corresponding to a weft yarn 5 previously inserted in a picking cycle prior to the improper picking cycle, and then gives a weft yarn extraction start signal to the control unit 35 to actuate the control unit 35 for control operation for extracting the weft yarn 5 inserted in the picking cycle prior to the improper picking cycle. The control unit 35 thus repeats the control routine a predetermined number of times to extract the improperly inserted weft yarn 5 and a plurality of weft yarns 5 inserted in the previous picking cycles prior to the improper picking cycle. Thus, the weft yarn extracting device 1 extracts a plurality of weft yarns inserted in picking cycles prior to the picking cycle in which a weft yarn is improperly inserted, in addition to the improperly inserted weft yarn.

Second Embodiment

Figure 5:
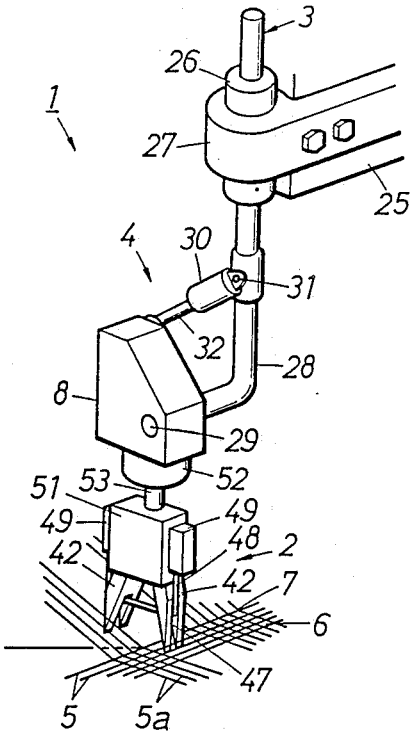
FIG. 5 is a perspective view of a weft yarn extracting device in a second embodiment according to the present invention.
Figure 6:
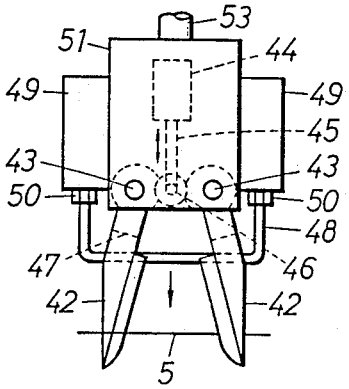
FIG. 6 is an enlarged front elevation of the weft yarn extracting device of FIG. 5.

Referring to FIGS. 5 and 6, a weft yarn extracting device 1 in a second embodiment according to the present invention comprises an extracting unit 2, a first shifting unit 3 and a second shifting unit 4. The extracting unit 2 is provided with a pair of fingers 42 instead of the rotary tube 11 and the nozzle 12 of the extracting unit 2 of the first embodiment. The pair of fingers 42 have each a base end pivotally supported by a pin 43 on a finger holder 51 and connected by a pin 46 to the extremity of the rod 45 of an actuator 44 provided within the finger holder 51, and a slit free end having a slit 47. A horizontal portion of a U-shaped ejecting bar 48 extends across the slits 47 of the fingers 42. The vertical legs of the ejecting bar 48 are connected for movement along the slits 47 respectively to the plungers 50 of solenoid actuators 49 attached to the finger holder 51. The finger holder 51 is joined to the extremity of the output shaft 53 of a motor 52 mounted on a holder 8. The motor 52 drives the finger holder 51 for rotation. A first shifting unit 3 and a second shifting unit 4 are the same in construction as those of the first embodiment, respectively.

Figure 7:
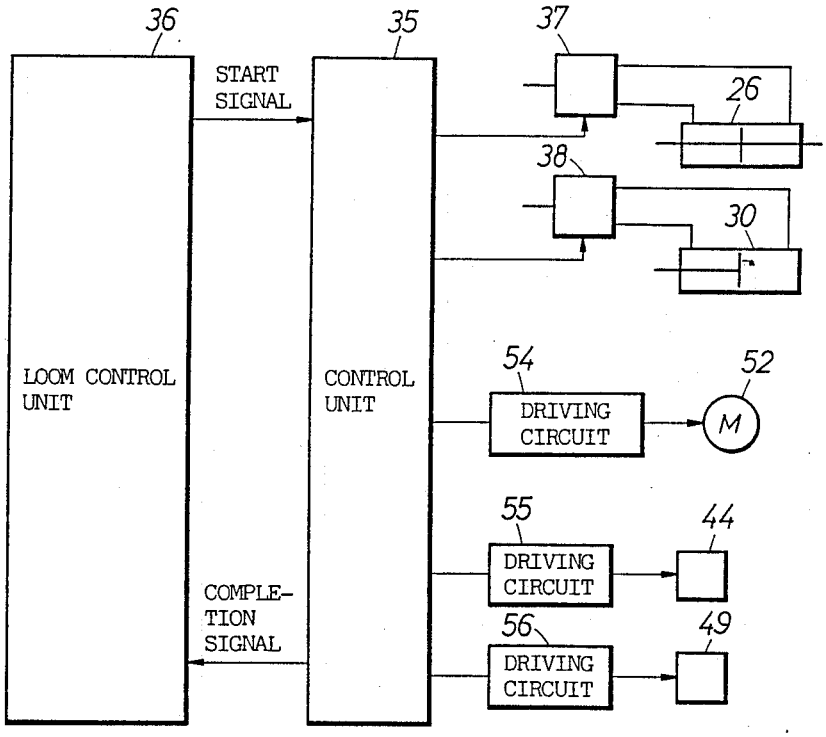
FIG. 7 is a block diagram of a control unit employed in the weft yarn extracting device of FIG. 5.

Referring to FIG. 7, a control unit 35 is connected to selector valves 37 and 38, a driving circuit 54 for driving the motor 52, a driving circuit 55 for driving the actuator 44, and a driving circuit 56 for driving the solenoid actuator 49. The control unit 35 controls the selector valves 37 and 38, and the driving circuits 54, 55 and 56 according to a predetermined control routine.

Figure 8:
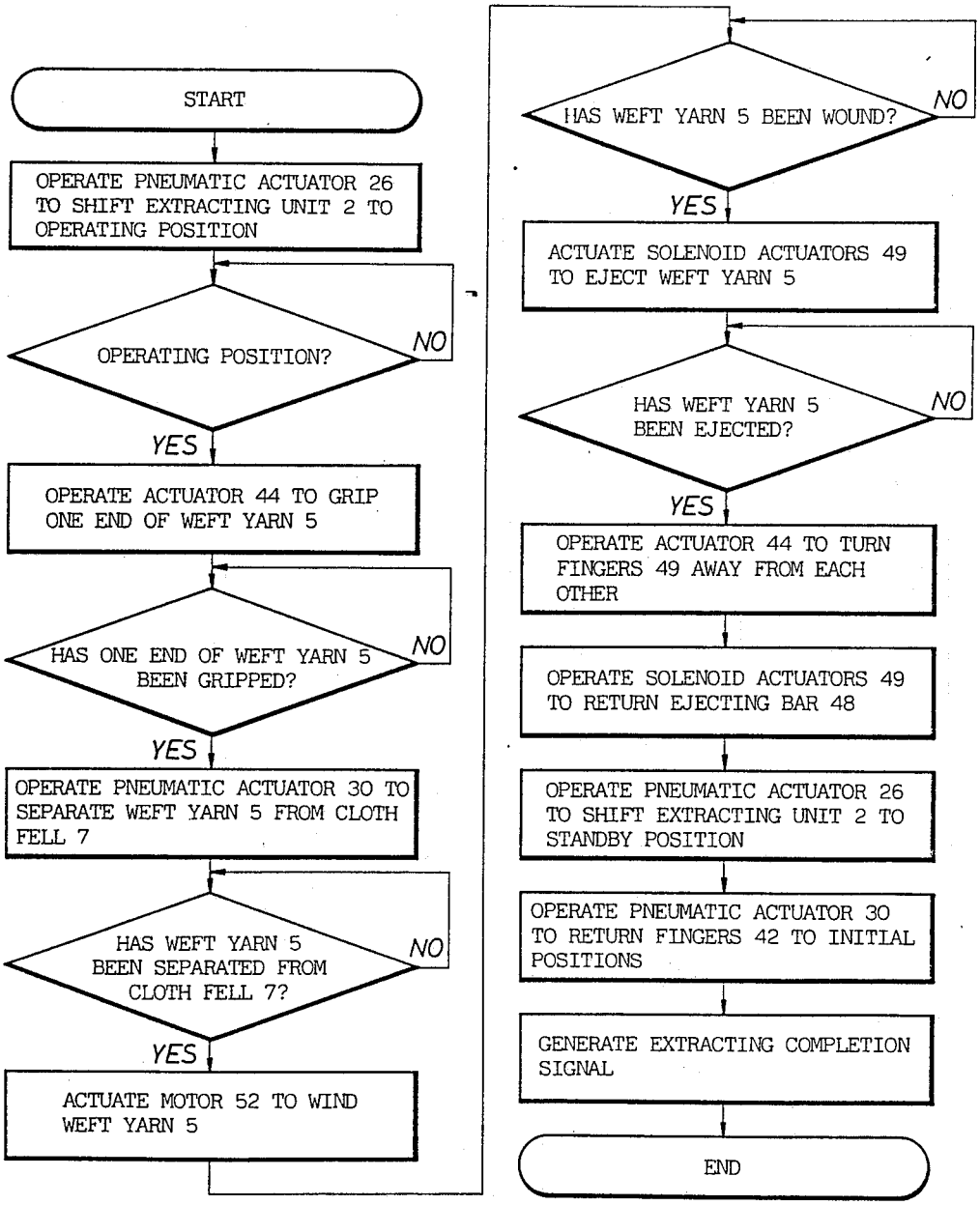
FIG. 8 is a flow chart of a control routine to be executed by the control unit of the weft yarn extracting device of FIG. 5.

Referring to FIG. 8, upon the reception of an extraction start signal from the control unit 36 of a loom, the control unit 35 operates the selector valve 37 to shift the extracting unit 2 from a standby position to an operating position, and then, after a determination that the operating position has been reached, actuates the driving circuit 55 to drive the actuator 44 so that the fingers 42 are turned toward each other to grip a weft yarn 5 to be extracted. After confirming the gripping of the weft yarn 5 with the fingers 42, the control unit 35 operates the selector valve 38 so that the pneumatic actuator 30 turns the holder 8 clockwise, as viewed in FIG. 5, to separate the weft yarn 5 from the cloth fell 7, and then, after a determination that the weft yarn 5 has been separated from the cloth fell 7, the control unit 35 actuates the motor 52 to rotate the finger holder 51 about the axis of the output shaft 53. Thus, the weft yarn 5 is wound around the pair of fingers 42 and is extracted from the cloth fell 7. Upon the completion of extraction of the weft yarn 5 and the confirmation thereof, the control unit 35 actuates the solenoid actuators 49 to move the ejecting bar 48 toward the extremities of the fingers 42 as indicated by an arrow in FIG. 6 to eject the weft yarn 5 coiled around the fingers 42 from the fingers 42, so that the weft yarn 5 falls into a waste basket, not shown, disposed below the extracting unit 2 or in an open end of a suction pipe connected to a waste basket, not shown. Upon the confirmation of ejection of the weft yarn 5, the control unit controls the driving circuit 55 to turn the fingers 42 away from each other by the actuator 44 and controls the driving circuit 56 to retract the ejecting bar 48 to its initial position by the solenoid actuators 49, and then controls the selector valves 37 and 38 actuate the pneumatic actuators 26 and 30 sequentially to return the extracting unit 2 to the standby position and to return the fingers 42 to their initial positions. An extracting completion signal is then generated. The operation then continues as in the first embodiment.

Modifications

Although the foregoing two embodiments each employ the first shifting unit 3 and the second shifting unit 4 to operate the holder 8 for a vertical movement and a turning motion, the first shifting unit 3 and the second shifting unit 4 may be replaced by known XY driving means capable of shifting the holder 8 in directions along an X-axis and a Y-axis, such as a combination of a belt-and-pulley mechanism and a rack-and-pinion mechanism.

The extracting unit 2 may be a device as disclosed in U.S. Pat. No. 4,664,157, which grips a weft yarn between a pair of winding members and rotates the winding members to extract the weft yarn.

Separate pieces of a broken pick can easily and completely be removed by providing the weft yarn extracting devices of the present invention between the selvage of the cloth and a series of interlacing yarns on the weft yarn arriving side of the loom, or by disposing a known weft extracting device disclosed in U.S. Pat. No. 4,502,512 or U.S. Pat. No. 4,688,606 near the selvage on the picking side of the loom, and the weft extracting device of the present invention near the selvage on the weft yarn arriving side of the loom. In such a case, the breakage of a picked weft yarn is detected by a weft yarn detector disposed at a position where the leading end of a picked weft yarn is unable to reach on the weft yarn arriving side, and a weft yarn detector disposed at a position where the leading end of the picked weft yarn is able to reach, and both the weft yarn extracting device disposed on the picking side and the weft yarn extracting device disposed on the weft yarn arriving side are actuated when the breakage of a picked weft yarn is detected by the detectors.

Although the invention has been described in its preferred form with a certain degree of particularity, it is to be understood that many variations and changes are possible in the invention without departing from the scope thereof.

What is claimed is:

1. A weft yarn extracting device comprising:

an extracting means for gripping one end of a weft yarn to be extracted and for winding the weft yarn to extract same from a cloth fell;

a first shifting means for shifting the extracting means between a standby position where the extracting means is kept standing by and an operating position where the extracting means grips the weft yarn; and a second shifting means for shifting the extracting means located at the operating position away from the cloth fell;

wherein said extracting means comprises: a holding member; a tubular case attached to the holding member; a rotary tube rotatably supported in the tubular case and provided with an axial bore; a nozzle axially slidably and rotatably supported in the tubular case opposite to the rotary tube so as to be moved axially toward and away from the rotary tube and including means for of jetting air to suck the weft yarn into the interior of the tubular case and to eject the weft yarn extracted from the cloth fell; and a rotative driving means for rotating the rotary tube and the nozzle.

2. A weft yarn extracting device comprising:

an extracting means for gripping one end of a weft yarn to be extracted and for winding the weft yarn to extract same from a cloth fell;

a first shifting means for shifting the extracting means between a standby position where the extracting means is kept standing by and an operating position where the extracting means grips the weft yarn; and a second shifting means for shifting the extracting means located at the operating position away from the cloth fell;

wherein said extracting means comprises: a holding member; a rotative driving means having an output shaft and attached to the holding member; a finger holding member joined to the output shaft of the rotative driving means; a pair of fingers each pivotally supported at one end thereof on the finger holding member by a pin; an actuating means for turning the pair of fingers on the pins toward each other and away from each other; an ejecting bar; a means for winding the weft yarn around the fingers and an ejecting bar driving means for driving the ejecting bar to eject the weft yarn wound around the fingers from the fingers.

3. A weft yarn extracting device according to claims 1 or 2, wherein said first shifting means comprises an actuating means having a piston rod, said piston rod swingably supporting the holding member of said extracting means on the extremity thereof, and a bracket fixedly holding the actuating means on a frame member of a loom.

4. A weft yarn extracting device according to claims 1 or 2, wherein first shifting means comprises an actuating means having a piston rod and said second shifting means comprises an actuating means pivotally joined to the piston rod of the actuating means of said first shifting means and also pivotally joined to the holding member of said extracting means.

* * * * *